US005630636A

United States Patent [19]

Karlsson

[11] Patent Number: 5,630,636

[45] Date of Patent: May 20, 1997

[54] CONTAINER YOKE

[75] Inventor: Gosta Karlsson, Killeberg, Sweden

[73] Assignee: Elmhults Konstruktion AB, Almhult, Sweden

[21] Appl. No.: 619,444

[22] Filed: Mar. 14, 1996

[30] Foreign Application Priority Data

Mar. 14, 1995 [SE] Sweden ..... 9500843-9

[51] Int. Cl.[6] ..... B66C 1/66

[52] U.S. Cl. ..... 294/81.21; 294/81.53

[58] Field of Search ..... 294/67.1, 67.33, 294/68.3, 81.1, 81.2, 81.21, 81.53, 81.54, 81.62, 119.1; 212/199, 230, 264, 296, 299; 403/109, 359, 363, 377; 414/718

[56] References Cited

U.S. PATENT DOCUMENTS

| | | | |
|---|---|---|---|
| 3,514,146 | 5/1970 | Zweifel et al. | 294/81.21 |
| 3,536,350 | 10/1970 | Backteman | 294/81.21 |
| 3,576,269 | 4/1971 | Shaffer | 294/81.21 X |
| 3,688,933 | 9/1972 | Rumell | 294/81.21 X |
| 3,874,719 | 4/1975 | Goyarts | 294/81.21 X |
| 4,606,568 | 8/1986 | Karlsson | 294/81.21 X |

FOREIGN PATENT DOCUMENTS

| | | | |
|---|---|---|---|
| 2502132 | 9/1982 | France | B66C 1/66 |
| 9212595 | 11/1992 | Germany | B66C 1/66 |

*Primary Examiner*—Johnny D. Cherry
*Attorney, Agent, or Firm*—Cushman Darby & Cushman IP Group of Pillsbury Madison & Sutro LLP

[57] ABSTRACT

A container yoke comprising a frame (1), axially moveable beams (2, 3) fitted in the frame and reciprocatingly moveable in relation thereto, and transverse beams (4) which are attached to the free ends of the axially moveable beams located outside of the frame (1) and which carry twist locks. Respective axially moveable beams (2, 3) are supported in the frame (1) by means of at least four support elements (7) disposed in mutually opposing pairs and engaging in grooves (6) disposed along the length of the axially moveable beams (2, 3) and in the horizontal bending plane (B) of the axially moveable beams.

5 Claims, 3 Drawing Sheets

CONTAINER YOKE

The present invention relates to a container yoke. Containers and other types of rigid load carriers of different standard dimensions are normally handled with the aid of a so-called yoke which includes a central frame, transverse beams arranged at the ends of the frame, and beams that are movable axially in relation to the frame. Mounted at each of the free ends of the transverse beams, said free ends forming the four corners of the container yoke, is a respective downwardly extending lifting hook, a so-called twist lock, which can be moved reciprocatingly through an angle of 90° with the aid of an hydraulic system for instance, and therewith hooked into and unhooked from a respective corresponding lifting aperture in each of said four corners.

It will be understood that such container yokes are used to handle large and heavy loads. Respective axially moveable beams are supported by the frame on its underside, where the axially moveable beams are already subjected to high compression stresses. This means that the beams will be subjected to unfavourable load patterns, and that the axially moveable beams will sooner or later become fatigued and eventually fracture, the time taken for this to occur depending on the weight of the loads handled. The useful life span of the axially moveable beams can be extended by reinforcing the beams with internally mounted strengthening wall-means, which of necessity must involve welding. Since such welds would weaken the beams, the reinforcements would have to be very strong and robust.

An object of the present invention is to greatly prolong the useful life of the axially moveable beams of a container yoke construction. This object is achieved with a container yoke that has the characteristic features set forth in the following claims.

Figure 1:
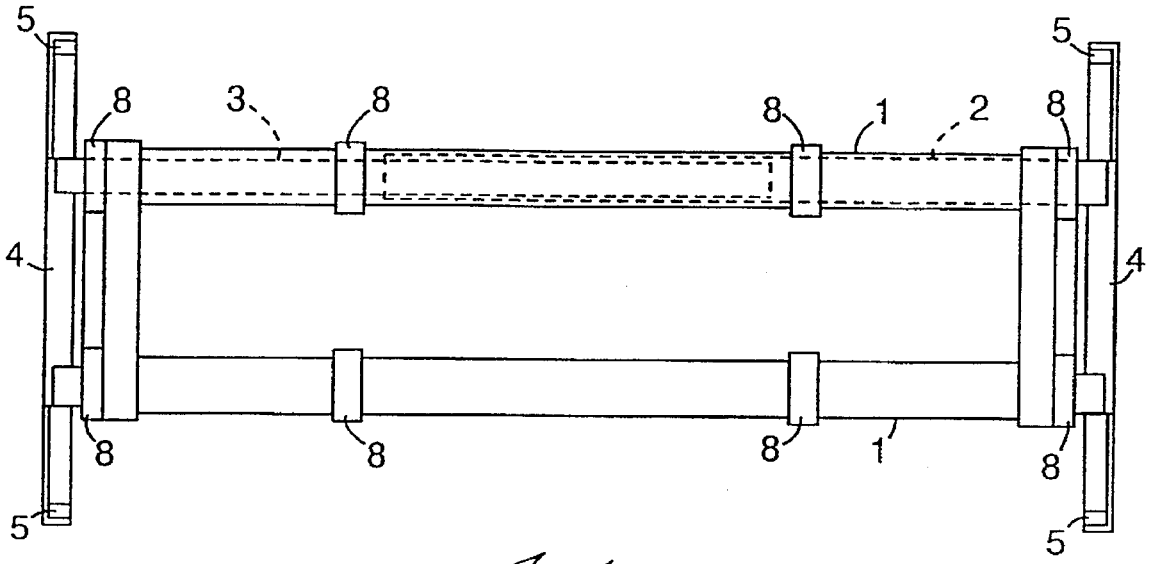
Figure 2:
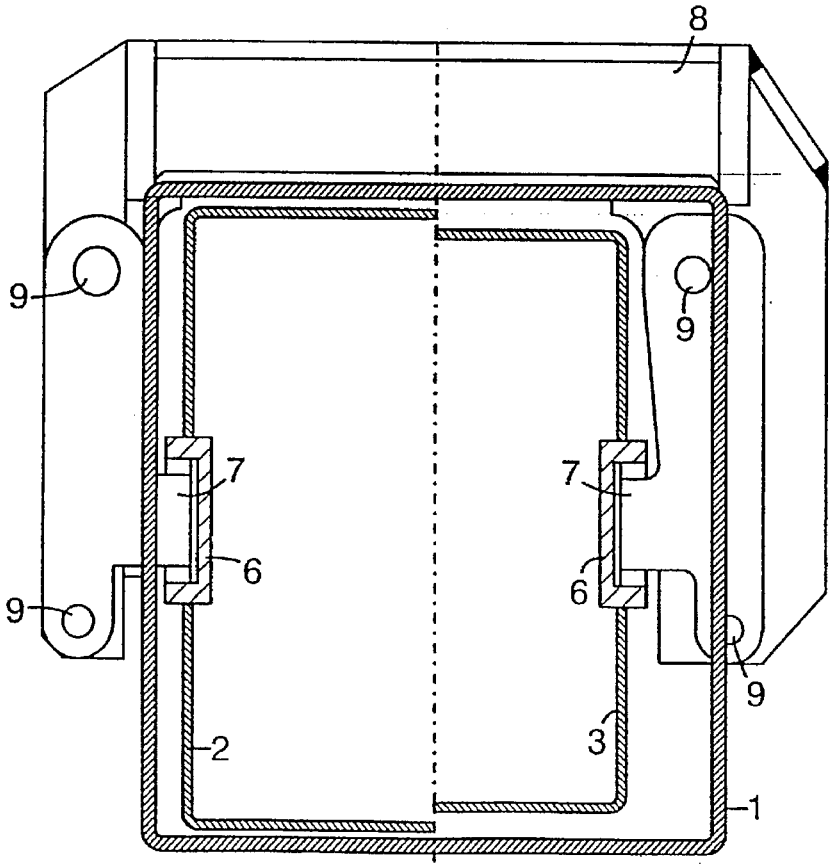
Figure 3:
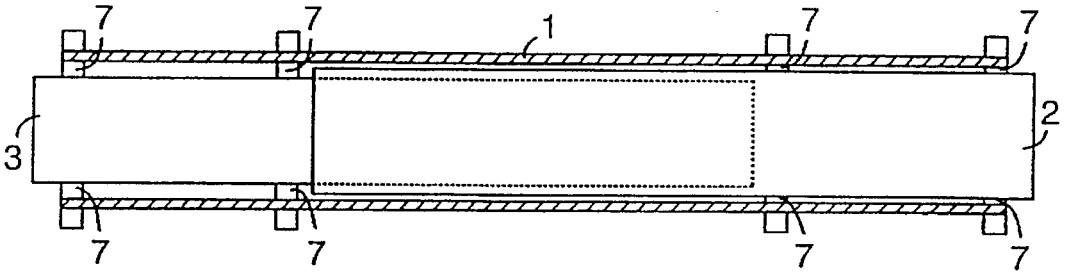
Figure 4A:
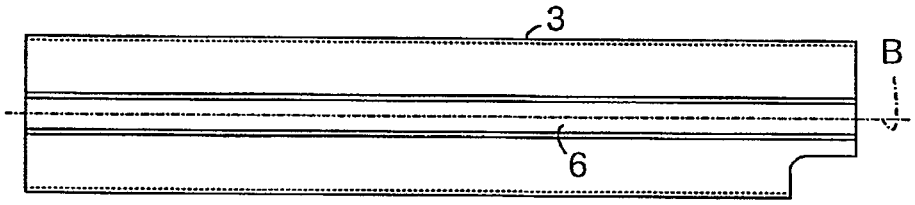
Figure 4B:
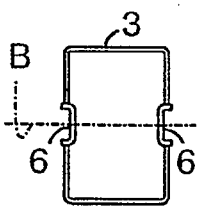
Figure 5:
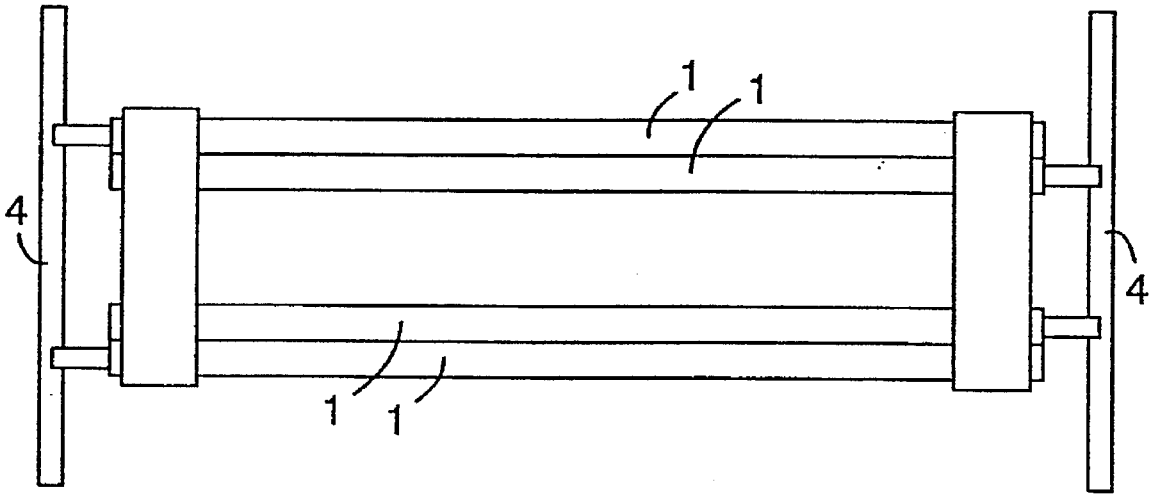

The invention will now be described in greater detail with reference to an exemplifying embodiment thereof and also with reference to the accompanying drawings, in which FIG. 1 is a schematic view of a container yoke from above; FIG. 2 is a schematic sectional view of an outer beam forming part of the frame, wherein the left half of the Figure is a sectioned view taken through the outer axially moveable beam and the right half of the Figure is a sectioned view taken through the inner axially moveable beam; FIG. 3 is a schematic horizontal sectioned view of a frame element with axially moveable beams; FIGS. *4a* and *4b* illustrate schematically the inner axially moveable beam from one side and from one end respectively; and FIG. 5 illustrates schematically another type of container yoke with which the invention can be applied.

FIG. 1 illustrates schematically a container yoke in the form of a frame comprising two mutually parallel outer beams 1 which are joined together at the ends thereof. An outer axially moveable beam 2 and an inner axially moveable beam 3 are moveable axially in respective outer beams 1. The free ends of the two outer axially moveable beams 2 that extend out from the outer beams 1 are joined together and carry a transverse beam 4. A twist lock 5 is mounted on each end of the transverse beam and functions to hook-up the container to be lifted, in a known manner. The same applies to the inner axially moveable beams 3, as shown in FIG. 1. This technique is known to the art.

FIG. 2 illustrate schematically and in section an outer beam 1 in which the outer and the inner axially moveable beams 2 and 3 respectively are carried for axial movement within the beam 1. Respective axially moveable beams 2 and 3 are divided along their horizontal bending plane B and a U-shaped profile 6 that extends along the axially moveable beam is fixedly welded at the dividing line. Respective axially moveable beams 2 and 3 are supported by four pairs of mutually opposite support elements 7 which are held fixed in relation to the outer beam 1 by means of holding means 8. Respective support elements 7 have the form of a hook means or block means which is replaceably screwed into the holding means 8 at 9. According to one embodiment the U-shaped profile provides a groove in which the hook means or block means engage. The actual load-supporting part of the U-shaped profile in the support elements 7 may also be replaceably mounted on the hook means.

The positions of the support elements 7 will be apparent from FIG. 3, which is a schematic sectioned view of a frame comprising two axially moveable beams as seen from above. As will clearly be seen, the two right-hand pairs of support elements 7 support the outer axially moveable beam 2 whereas the two left-hand pairs of support elements 7 support the inner axially moveable beam 3. It will be seen from FIGS. 2 and 3 that the axially moveable beams move freely with no contact therebetween and without contact with the outer beam 1, the only guiding and supporting contact with the frame being obtained through the medium of respective pairs of support elements 7 for respective axially moveable beams. The inner ends of respective axially moveable beams are completely free-supporting when the axially moveable beams 2 and 3 are in the inwardly inserted position shown in FIG. 3. It will be understood that respective axially moveable beams 2 and 3 can not be drawn out of their respective outer beams 1 to such an extent that the inner end of the axially moveable beam will no longer be in supportive contact with the inner pair of supporting elements 7.

Because the axially moveable beams of the container yoke are supported in a plane that extends through the bending axis or neutral axis B of the axially moveable beam, ie where the tensile load on the upper side of the axially moveable beam and the pressure load on the underside of said beam is equalized to zero, no further pressure forces will be superposed on the axially moveable beam from the supporting elements, as distinct from the case of conventional container yokes with which the axially moveable beams are supported on the underside of the frame. It has been possible to greatly extend the useful life of the container yoke and the axially moveable beams in this way. It will be understood that the axially moveable beams are moved in the central beams when no load acts on the yoke and that the function of the supporting elements 7 is therefore essentially solely a supporting function.

It will be understood that the invention can also be applied to container yokes of the kind where the outer beams of the frame each support only one axially moveable beam as shown schematically in FIG. 5, which illustrates a container yoke of conventional design. The invention can, of course, also be applied to a container yoke that comprises a frame which includes only one center beam in which axially moveable beams are carried.

Although not shown, the container yoke will include conventional lifting eyes and like container handling devices.

I claim:

1. A container yoke comprising a frame (1), axially moveable beams (2, 3) fitted in the frame and axially moveable reciprocatingly in relation thereto, and transverse beams (4) which are attached to the free ends of the axially moveable beams that extend beyond the frame (1), characterized in that respective axially moveable beams (2, 3) are supported in the frame (1) by means of at least four support elements (7) disposed in mutually opposing pairs and engaging in grooves (6) disposed along the length of the axially moveable beams (2, 3) and in the horizontal bending plane (B) of said axially moveable beams.

2. A container yoke according to claim 1, characterized in that respective grooves are formed by a U-shape profile (6) welded firmly along respective axially moveable beams (2, 3).

3. A container yoke according to claim 2, characterized in that respective supporting elements (7) have the form of a block (7) attached to the frame (1) and engaging in the groove (6).

4. A container yoke according to claim 1, characterized in that respective supporting elements (7) have the form of a block (7) attached to the frame (1) and engaging in the groove (6).

5. A container yoke according to claim 4, characterized in that the blocks (7) can be replaced.

* * * * *